US011818536B2

(12) United States Patent
Shumard et al.

(10) Patent No.: US 11,818,536 B2
(45) Date of Patent: Nov. 14, 2023

(54) AUDIO DEVICES HAVING LOW-FREQUENCY EXTENSION FILTER

(71) Applicant: Shure Acquisition Holdings, Inc., Niles, IL (US)

(72) Inventors: Brent Robert Shumard, Mount Prospect, IL (US); Thomas Andrew Satrom, Chicago, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 17/528,887

(22) Filed: Nov. 17, 2021

(65) Prior Publication Data

US 2022/0159370 A1 May 19, 2022

Related U.S. Application Data

(60) Provisional application No. 63/115,532, filed on Nov. 18, 2020.

(51) Int. Cl.
*H04R 1/28* (2006.01)

(52) U.S. Cl.
CPC ..... *H04R 1/2873* (2013.01)

(58) Field of Classification Search
CPC ..... H04R 1/28; H04R 1/2803; H04R 1/2807; H04R 1/2811; H04R 1/2815;
(Continued)

(56) References Cited

U.S. PATENT DOCUMENTS 1,969,704 A 8/1934 D'Alton
2,646,852 A * 7/1953 Forrester ..... H04R 1/2857 312/7.1
(Continued)

FOREIGN PATENT DOCUMENTS

CN 114745631 A * 7/2022
DE 20314657 U1 * 11/2003 ..... H04R 1/2826
(Continued)

OTHER PUBLICATIONS

Mar. 16, 2022—(WO) International Search Report and Written Opinion—App PCT/US2021/072468.
(Continued)

*Primary Examiner* — Ryan Robinson
(74) *Attorney, Agent, or Firm* — Banner & Witcoff, Ltd.

(57) ABSTRACT

A filter that may increase and extend, the bass frequency response of a speaker of an audio device. The filter may be space-efficient. The filter may be part of a device that does not necessarily have a large rear cavity and that does not necessarily have porting and/or passive radiating. The low-frequency extension filter may be used, for example, with a smaller rear cavity while essentially simulating the acoustic effects of a much larger rear cavity. The low-frequency extension filter may include a plurality of acoustic pathways, such as tubes, which may wind around along a tortuous path and which may resemble a labyrinthine design. The tubes may be selected to resonate with particular predetermined low frequency channels. For example, the tubes may be approximately a quarter wavelength of the center of the corresponding frequency channel, or even slightly shorter.

20 Claims, 12 Drawing Sheets

(58) Field of Classification Search
CPC .. H04R 1/2819; H04R 1/2823; H04R 1/2826; H04R 1/2838; H04R 1/2842; H04R 1/2846; H04R 1/2849; H04R 1/2853; H04R 1/2857; H04R 1/2869; H04R 1/2873; H04R 1/2884; H04R 1/28888
See application file for complete search history.

(56) References Cited

U.S. PATENT DOCUMENTS

| | | | | |
|---|---|---|---|---|
| 2,880,817 | A * | 4/1959 | Burns | H04R 1/2811 381/349 |
| 4,168,761 | A * | 9/1979 | Pappanikolaou | H04R 1/2857 181/194 |
| 4,800,983 | A | 1/1989 | Geren | |
| 6,062,338 | A * | 5/2000 | Thompson | H04R 1/2819 181/152 |
| 6,356,643 | B2 * | 3/2002 | Yamagishi | H04R 1/2857 381/349 |
| 6,634,455 | B1 | 10/2003 | Yang | |
| 6,896,096 | B2 * | 5/2005 | Nevill | H04R 1/30 381/345 |
| 7,201,252 | B2 * | 4/2007 | Nevill | H04R 1/345 381/345 |
| 7,284,638 | B1 | 10/2007 | Sahyoun | |
| 8,983,101 | B2 | 3/2015 | Grinker et al. | |
| 10,291,984 | B2 * | 5/2019 | Li | H03F 3/2173 |
| 10,425,721 | B1 * | 9/2019 | Krueger | H04R 1/2857 |
| 10,536,769 | B2 * | 1/2020 | Griffiths | H04R 1/2857 |
| 10,735,852 | B2 * | 8/2020 | Matsumura | H04R 1/2826 |
| 2013/0004008 | A1 * | 1/2013 | Kuo | H04R 1/2834 381/349 |
| 2017/0325018 | A1 * | 11/2017 | Tomar | H04R 1/2811 |
| 2020/0037064 | A1 | 1/2020 | Mathur | |

FOREIGN PATENT DOCUMENTS

| | | | |
|---|---|---|---|
| FI | 20187175 | A1 * | 5/2020 |
| GB | 626623 | A * | 7/1949 |
| WO | WO-2022102360 | A1 * | 5/2022 |

OTHER PUBLICATIONS

Bailey A R: "A Non-resonant Loudspeaker Enclosure Design. Using acoustic transmission line with low-pass filter characteristics", vol. 196510 Oct. 1, 1965 (Oct. 1, 1965), p. 7pp, XP007911541, Retrieved from the Internet: URL:http://audioweb.cz/down/a-non-resonant-loudspeaker-enclosure-design.pdf [retrieved on Feb. 5, 2010] figure 3.

Degraeve, et al., "Metamaterial Absorber for Loudspeaker Enclosures," Jun. 2020.

Ni, et al. "Acoustic Rainbow Trapping by Coiling Up Space," Nov. 2014.

Zhao, et al. "Enhancing Monochromatic Multipole Emission by a Subwavelength Enclosure of Degenerate Mie Resonances," Jul. 2017.

* cited by examiner

AUDIO DEVICES HAVING LOW-FREQUENCY EXTENSION FILTER

CROSS-REFERENCE TO RELATED APPLICATIONS

The present application claims priority to U.S. Provisional Patent Application Ser. No. 63/115,532, filed Nov. 18, 2020, hereby incorporated by reference as to its entirety for all purposes.

BACKGROUND

Portable audio devices, such as speakerphones, portable speakers (e.g., smart speakers and/or BLUETOOTH speakers), often have a small form factor. The small size of these devices may present a variety of challenges.

For example, it is a design challenge to produce sufficient bass response in a speaker of a small audio device, due to the lack of room to provide a large rear cavity within the device and behind the speaker. While this is sometimes overcome using porting (appropriate openings in the rear cavity) or a passive radiator, ports are not always desirable because they can introduce distortions that are not suitable for all use cases. For example, acoustic echo cancellation (AEC) requires special considerations with porting or with passive radiators because they can introduce nonlinearities; their effects may be relatively uncorrelated with the sound source (the speaker) in magnitude and phase, reducing the AEC's effectiveness at canceling echoes. On the other hand, AEC is desirable for many use cases, such as for speakerphones.

SUMMARY

The following summary presents a simplified summary of certain features. The summary is not an extensive overview and is not intended to identify key or critical elements.

For example, according to some aspects, a device may be provided that comprises a low-frequency extension filter. This filter may increase (and thus effectively extend) the bass response of the speaker in the device, without necessarily taking up much room in the device. Normally, to provide a lot of bass response, a large rear cavity, porting, and/or a passive radiator is used. However, as discussed previously, porting and passive radiating are not always compatible with the device's use case, and a large rear cavity is not feasible in a small form-factor device. Therefore, a low-frequency extension filter is provided that may increase bass frequency response without the need for a large rear cavity and without the need for porting and/or passive radiating. In fact, the low-frequency extension filter may be used with a smaller rear cavity while essentially simulating the acoustic effects of a much larger (and less feasible) rear cavity. The low-frequency extension filter may include a plurality of tubes, which may wind around along a tortuous path (and which may resemble a labyrinthine design), where the tubes are selected to resonate with particular predetermined low frequency channels. For example, the tubes may resonate at a quarter wavelength (for example, have a length approximately equal to the quarter wavelength, or even slightly less than the quarter wavelength for reasons discussed herein) of the center of the corresponding frequency channel.

According to further aspects, an audio apparatus may be provided that comprises a housing forming an interior space, a speaker connected to the housing and configured to emit sound, and a low-frequency filter disposed within the interior space. The low-frequency filter may be configured to filter a plurality of frequency bands within a stiffness-controlled response domain of the audio apparatus. The low-frequency filter may comprise a plurality of acoustic pathways. Each of the plurality of acoustic pathways may comprise a first end that is open to the interior space and a second end that is closed. Each of the plurality of acoustic pathways may have a different length corresponding to a different frequency band of the plurality of frequency bands within the stiffness-controlled response domain of the audio device.

According to further aspects, an audio apparatus may be provided that comprises a low-frequency filter configured to filter within an octave range of frequencies below a particular frequency, such as below about 500 Hz. The low-frequency filter may comprise a plurality of acoustic pathways. Each of the plurality of acoustic pathways may comprise a first end that is open such that at least a portion of acoustic energy received by the low-frequency filter is received at the first end. Each of the plurality of acoustic pathways may comprise a second end that is closed. Each of the plurality of acoustic pathways may comprise a different tortuous acoustic pathway and has a different length corresponding to a different frequency band of a plurality of frequency bands within the octave range of frequencies below the particular frequency.

According to further aspects, an audio apparatus may be provided that comprises a housing forming an interior space, a speaker connected to the housing and configured to emit sound, and a low-frequency filter disposed within the interior space. The low-frequency filter may be configured to filter a plurality of frequency bands below a transition point frequency where a mass-controlled response domain of the audio apparatus begins. The low-frequency filter may comprise a plurality of acoustic pathways. Each of the plurality of acoustic pathways may comprise a first end that is open to the interior space and a second end that is closed. Each of the plurality of acoustic pathways may have a different length corresponding to a different frequency band of the plurality of frequency bands below the transition point frequency where the mass-controlled response domain of the audio apparatus begins.

These and other features and potential advantages are described in greater detail below.

BRIEF DESCRIPTION OF THE DRAWINGS

Some features are shown by way of example, and not by limitation, in the accompanying drawings. In the drawings, like numerals reference similar elements.

DETAILED DESCRIPTION

Figure 1:
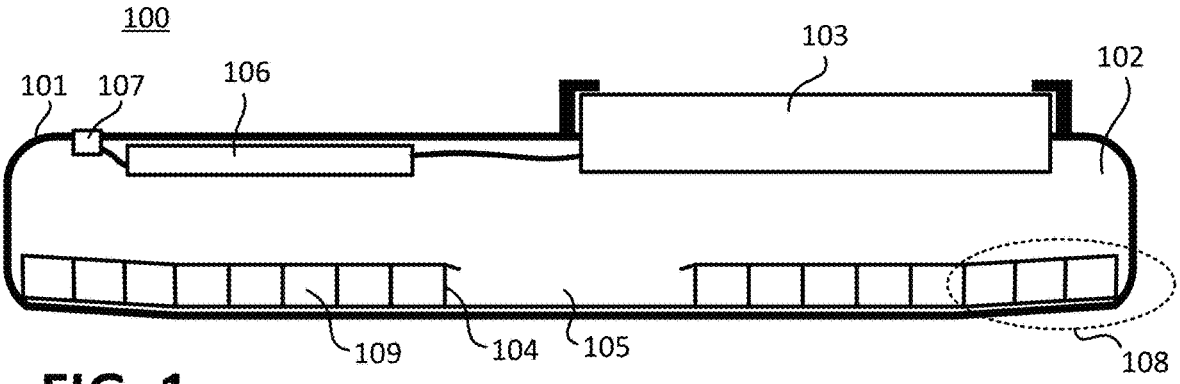
FIG. 1 is a side view of an example device comprising a speaker, a microphone, and a low frequency extension filter.

The accompanying drawings, which form a part hereof, show examples of the disclosure. It is to be understood that the examples shown in the drawings and/or discussed herein are non-exclusive and that there are other examples of how the disclosure may be practiced.

Figure 2:
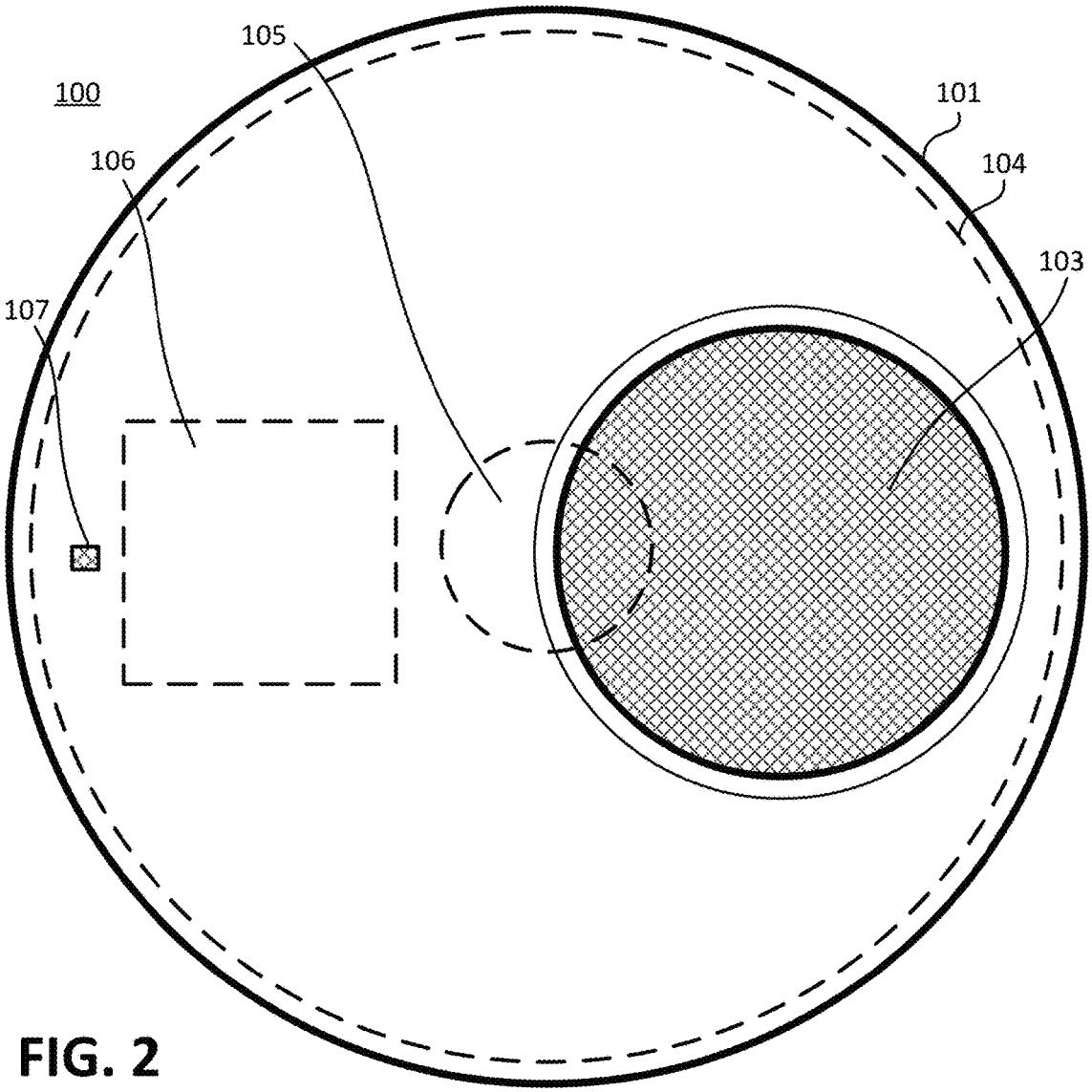
FIG. 2 is a top view of the device of FIG. 1.

FIG. 1 is a side view of an example device 100, and FIG. 2 is a top view of device 100. Device 100 as shown comprises a speaker driver 103 and a microphone 107, although device 100 may include multiple drivers and/or multiple microphones, and alternatively may not include a microphone at all. Device 100 may further comprise a housing 101 (which may also be a main body of device 100) that holds driver 103 and microphone 107 in fixed positions, and which may partially or fully enclose a controller 106 electrically connected with driver 103 and microphone 107. Housing 101 may further partially or fully enclose a structure that will be referred to herein as a low frequency extension filter 104, and that will be described in further detail below.

Controller 106 may control the operations of device 100, including the operations of driver 103 and/or microphone 107. For example, controller 106 may receive electrical signals produced by microphone 107 in response to (and representative of) sounds detected by microphone 107), and process those received electrical signals in any desired manner, such as by storing data representing the detected sounds in memory, or sending communications to a location external to device 100 representing the detected sounds. Controller 106 may further include circuitry for generating signals representing sounds to be emitted by driver 103. For example, controller 106 may receive electrical signals from a location outside device 100 and cause sounds to be emitted by driver 103 based on those signals. Such communications external to device 100 may be conducted via one or more electrical wires (such as a USB connection) and/or via a wireless connection such as Wi-Fi or cellular communications. In the latter case, controller 106 may include a wireless communication module such as a Wi-Fi communication module, cellular network communication module, and/or a BLUETOOTH communication module. Controller 106 may be implemented as, for example, a computing device that executes stored instructions, and/or as hard-wired circuitry that may or may not executed stored instructions.

While driver 103 may be directed so as to primarily direct sound outward from device 101 (e.g., in a generally upward direction in FIG. 1), driver 103 may further emit sound in at least a rearward direction, into a rear enclosed cavity 102 defined by housing 101. A driver without a rear cavity (e.g., a free air driver) generally radiates sound inefficiently because the driver is radiating in both the forward and backward directions equally, which sums to zero in the far field. The housing behind a driver typically sets the radiation conditions, and the size of the rear cavity enclosed by the housing affects the air stiffness rearward of the driver. To optimize forward radiation by the driver, then, enclosed cavity 102 may be suitable for collecting and containing rearward sound radiated into housing 101 from the interior (rearward) facing portion of driver 103. By capturing the rearward radiated sound, enclosed cavity 102 ideally has a geometry that appropriately sets the rearward air stiffness and damping experienced by the system to be at a critical point, such that sound primarily radiates only (or at least mostly) from the exposed (front) surface of the driver. However, as explained above, it may be difficult to fit a cavity of the required geometry (e.g., size and/or shape) into a portable audio device.

One way to implement a rear cavity is to include resonating tubes therein, which force the sound from the rear of the driver to travel via a particular acoustic path within the enclosure. In some cases, the rear cavity may be fully sealed (no acoustically significant openings). In other cases, the rear cavity may have one or more openings, called ports. In further cases, the rear cavity may have a passive radiator that flexes in response to acoustic energy, thereby dynamically changing the acoustic response of the rear cavity over time in a desirable way.

A closed tube quarter wave resonator (a tube with the near/source end open and the far end closed) can create a minimized (e.g., zero) impedance condition for a specific frequency as well as lowered impedance in the small band around that frequency if the geometric conditions are well designed (e.g., flared entrance and/or damped cavity). Using a series of these quarter wave resonators in overlapping or nearly overlapping frequency bands may produce a sealed condition that approximates the free air behavior of a driver in a specific frequency region. This has a potential benefit of extending the efficient radiation of low frequencies due to the effective removal of the air stiffness of the enclosed (e.g., sealed) cavity at the specific frequencies that are designated by the individual resonators. The resonators may be tuned to a series of frequencies that are lower than the characteristic rear frequency of the first order driver/enclosure system, in order to potentially improve the low frequency radiation efficiency of the system. This also may effectively lower the requisite cavity volume needed for a given frequency response for a given driver.

To implement a plurality of such resonators, low frequency extension filter 104 may comprise a plurality of tubes through which sound from driver 103 may pass. At least a portion of each tube (also referred to herein as a passageway) may follow a tortuous path in order to reduce the volume needed to hold the tube. One such tube is indicated in FIG. 1 by way of example as element 109. Sound from driver 103 may pass through enclosed cavity 102, down into a central cavity 105 of low frequency extension filter 104, and into one or more of its tubes. As will be described in more detail, the tubes may be configured so as to amplify (e.g., produce additive resonances) certain low-frequency sounds radiated from driver 103, thereby effectively extending the bass response of driver 103. The low frequency extension filter 104 may allow device 100 to have a smaller enclosed cavity 102. This is because when the sound passes into and reflects within the tubes, the sound therein may resonate in much the same way that it would in a much larger traditional enclosed cavity.

FIG. 2 shows low frequency extension filter 104 having a body that may be generally circular (e.g., disc-like) in shape as viewed from the top. However, this is but one example;

low frequency extension filter 104 may alternatively have a body of any other shape, such as a rectangular shape, an oval shape, a cube shape, or any other geometric or non-geometric two-dimensional or three-dimensional shape. Moreover, low frequency extension filter 104 may or may not have a substantially flat profile when viewed by the side. For example, FIG. 1 shows low frequency extension filter 104 having an outer circumferential portion 108 that bends at an angle upwardly to follow the contour of the outer bottom portion of housing 101. This ability to bend may allow low frequency extension filter 104 to fit more readily into an arbitrarily-shaped housing 101 and may serve to reduce limitations on the shape and/or size of housing 101. In general, the shape of low frequency extension filter 105 may be designed to fit into housing 101 in a way that allows housing 101 to be a desired size and shape, for instance to allow housing 101 to be part of a portable (e.g., hand-held) audio device. The tubes within of low frequency extension filter 105 may be routed to fit as needed within the body shape of low frequency extension filter 105. Moreover, the number and lengths of the tubes, as well as their cross-sectional areas, may be designed based on the number of desired corresponding frequency bands to be filtered, their center frequencies, and other design factors. Thus, low frequency extension filter 105 may have an overall shape that has a geometry generally independent of the tubes routed therein, and may be designed so as to fit within housing 101, as long as the body of low frequency extension filter 105 is of sufficient size to contain the tubes.

Figure 3:
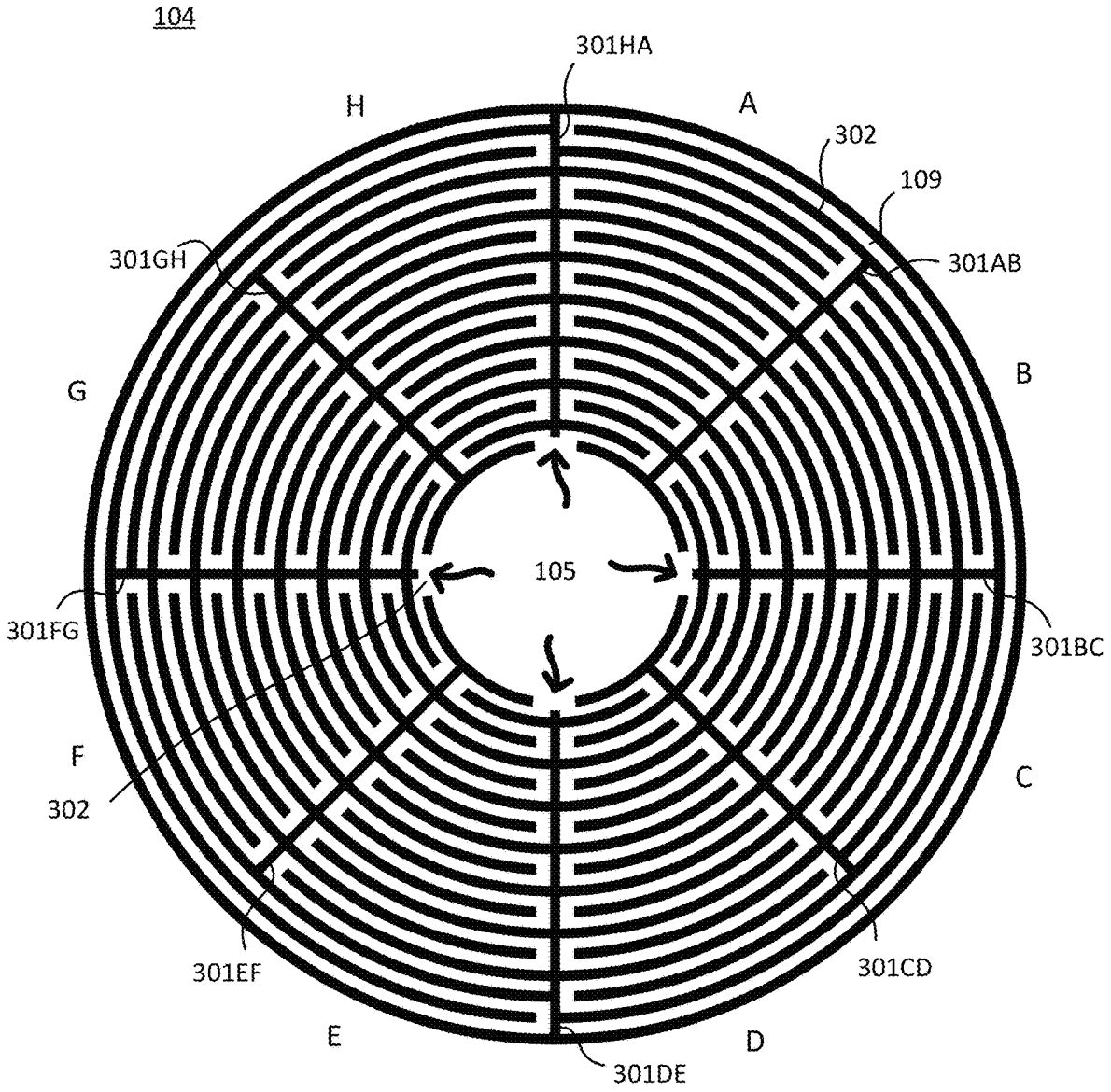
FIGS. 3-7 are top views of an example low frequency extension filter.

FIG. 3 shows a more detailed top view of low frequency extension filter 104. As is evident from the figure, low frequency extension filter 104 may be laid out as a plurality of circumferential walls 302 centered around central cavity 105. Moreover, there may be a plurality of radially-extending (or otherwise outwardly-extending) walls 301 extending between central cavity 105 an outer circumference (or other outer boundary) of low frequency extension filter 104. The walls together may form a plurality of sections, such as the sections labeled A, B, C, D, E, F, G, H, each generally shaped like a slice of pie (an angular section of the disc), although not necessarily limited to the confines of the pie "slice." In the shown example, section A is generally the section located between radial walls 301HA and 301AB, section B is generally the section located between radial walls 301AB and 301BC, section C is generally the section located between radial walls 301BC and 301CD, section D is generally the section located between radial walls 301CD and 301DE, section E is generally the section located between radial walls 301DE and 301EF, section F is generally the section located between radial walls 301EF and 301FG, section G is generally the section located between radial walls 301FG and 301GH, and section H is generally the section located between radial wall 301GH and 301HA.

As will be explained further below, each of these sections may correspond to a particular one of the tubes, which may each correspond to a particular resonant frequency band. This is because each section may utilize a different tube length tuned to one of the resonant frequency bands. In the shown example, there are eight corresponding resonant frequency bands (each corresponding to a different one of the eight tubes). However, low frequency extension filter 104 may be configured to have any number of sections and therefore any number of corresponding resonant frequency bands. To tune a tube to a particular frequency band, the tube (which may be open on only one end) may have a length that is approximately one quarter of the wavelength of the central frequency of the frequency band. However, as will be described further below, the length of each tube may be less than one quarter of the wavelength by designing the tubes to take advantage of tube wall viscous loss characteristics. Such shorter tube lengths may allow low frequency extension filter 104 to be smaller than it otherwise would, and/or may allow the tubes therein to be tuned to lower frequencies than they otherwise would using the same tube lengths without designing in appropriate tube wall absorption.

It can also be seen from FIG. 3 that central cavity 105 opens laterally into a plurality of openings, such as opening 302. In the shown example, there are four such smaller lateral openings, however there may be any number of lateral openings as desired. Each lateral opening may open into one, two, or more tubes 109. In the shown example, each lateral opening opens into two different tubes, such that each pair of tubes shares a lateral opening from central cavity 105. Sound from driver 103 may pass into central cavity 105, and then into the lateral openings as indicated by four arrows in central cavity 105. Alternatively, there could be eight separate non-co-located lateral openings in this eight-frequency band example, one for each of the sections.

Figure 4:
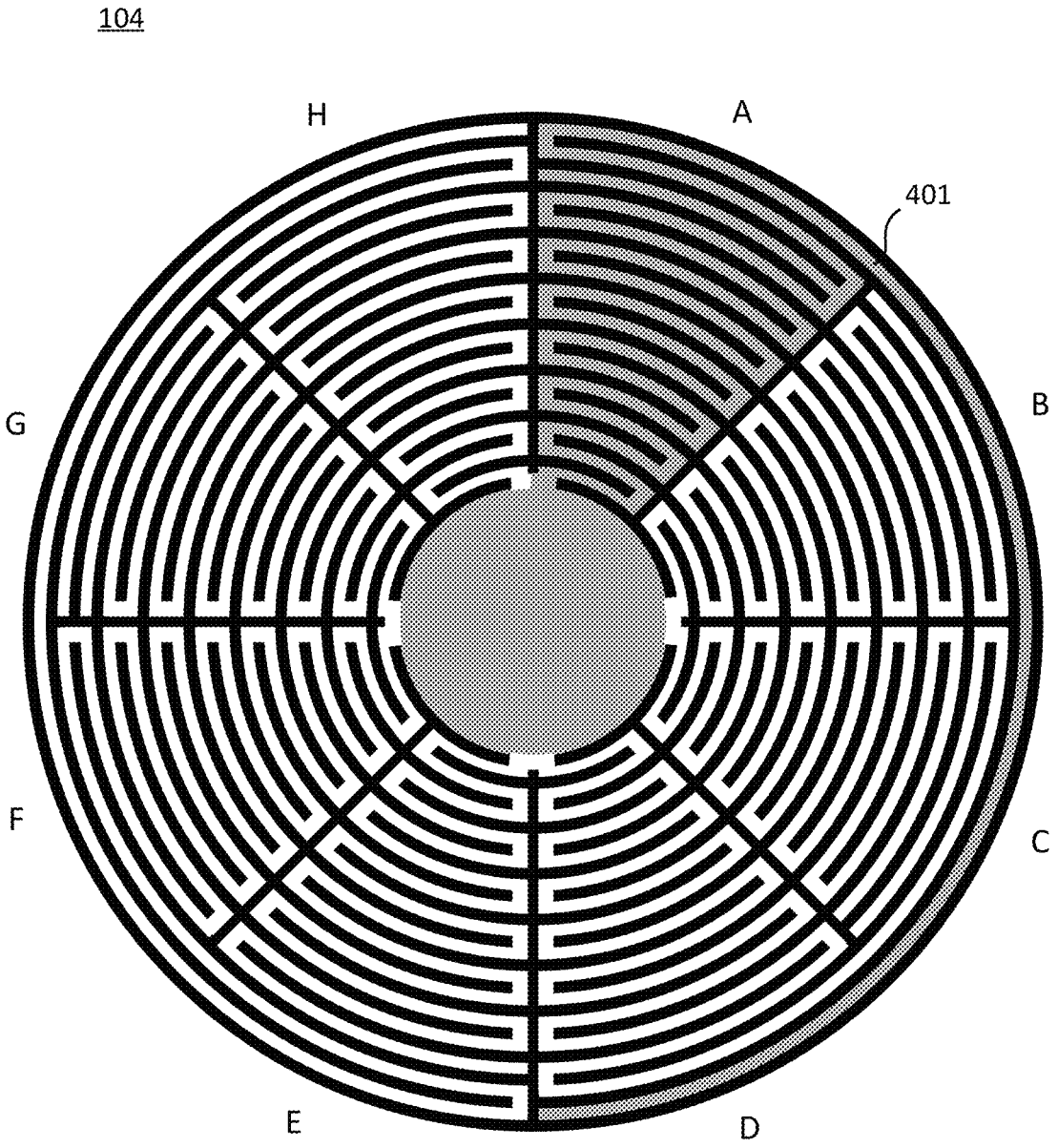

For each section, the corresponding tube may wind back and forth (e.g., along a tortuous path) to generally fit (albeit not necessarily completely) within one of the pie-slice-shaped sections. For example, FIG. 4 shows one of the tubes 401, corresponding to section A, emphasized to make it easier to distinguish the tube from the other tubes and sections of low frequency extension filter 104. Note that tube 401 does not necessarily remain entirely within the section designated as section A, and extends angularly outward from that pie-shaped region as needed to accommodate the desired length of tube 401 (beyond radial wall 301AB).

Figure 5:
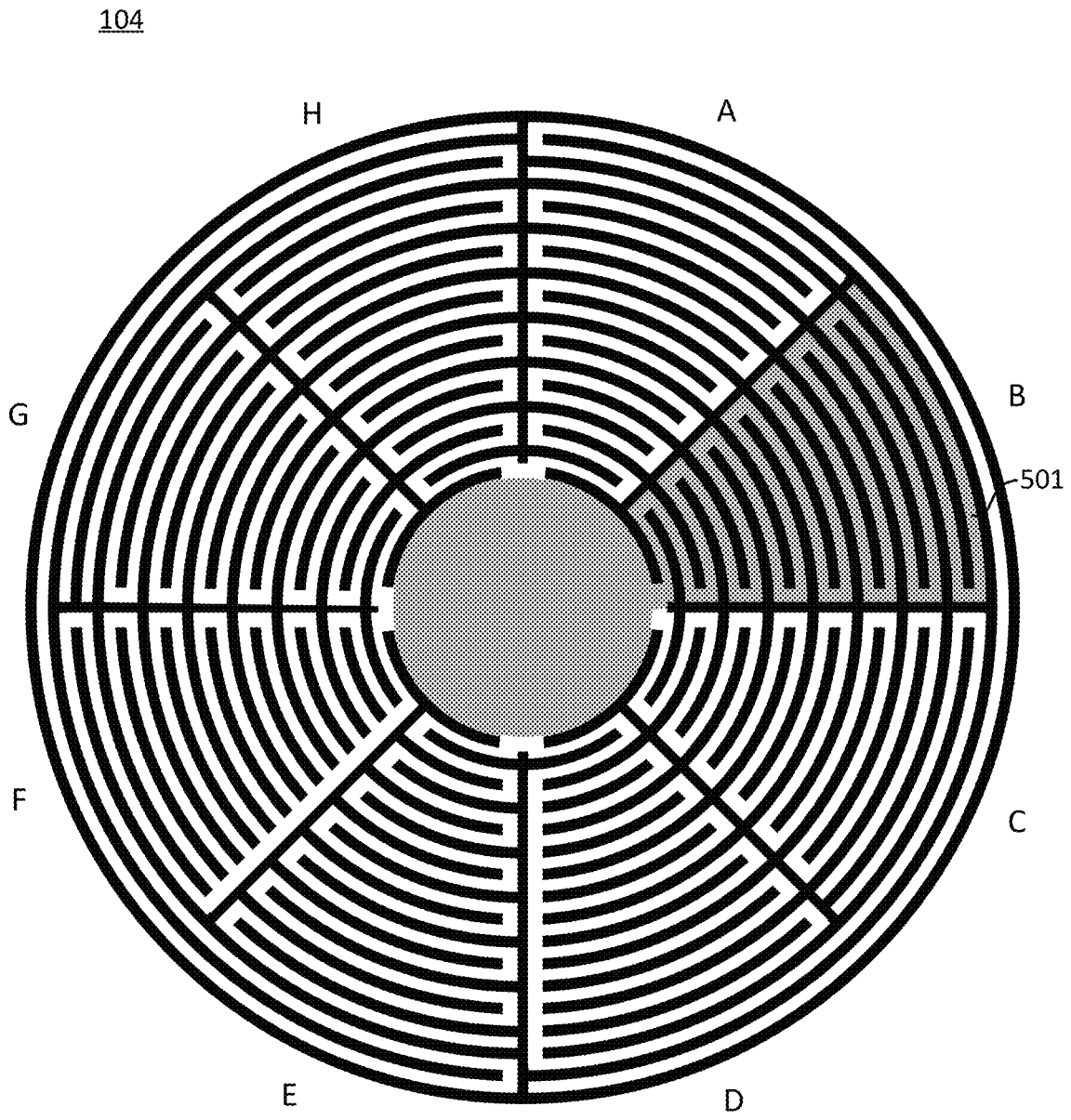

FIG. 5 shows another example of a tube 501 that corresponds to section B, again emphasized to make it easier to distinguish the tube from the other tubes and sections of low frequency extension filter 104. In this example, tube 501 remains within the pie-shaped section defined between radial walls 301AB and 301BC.

Figure 6:
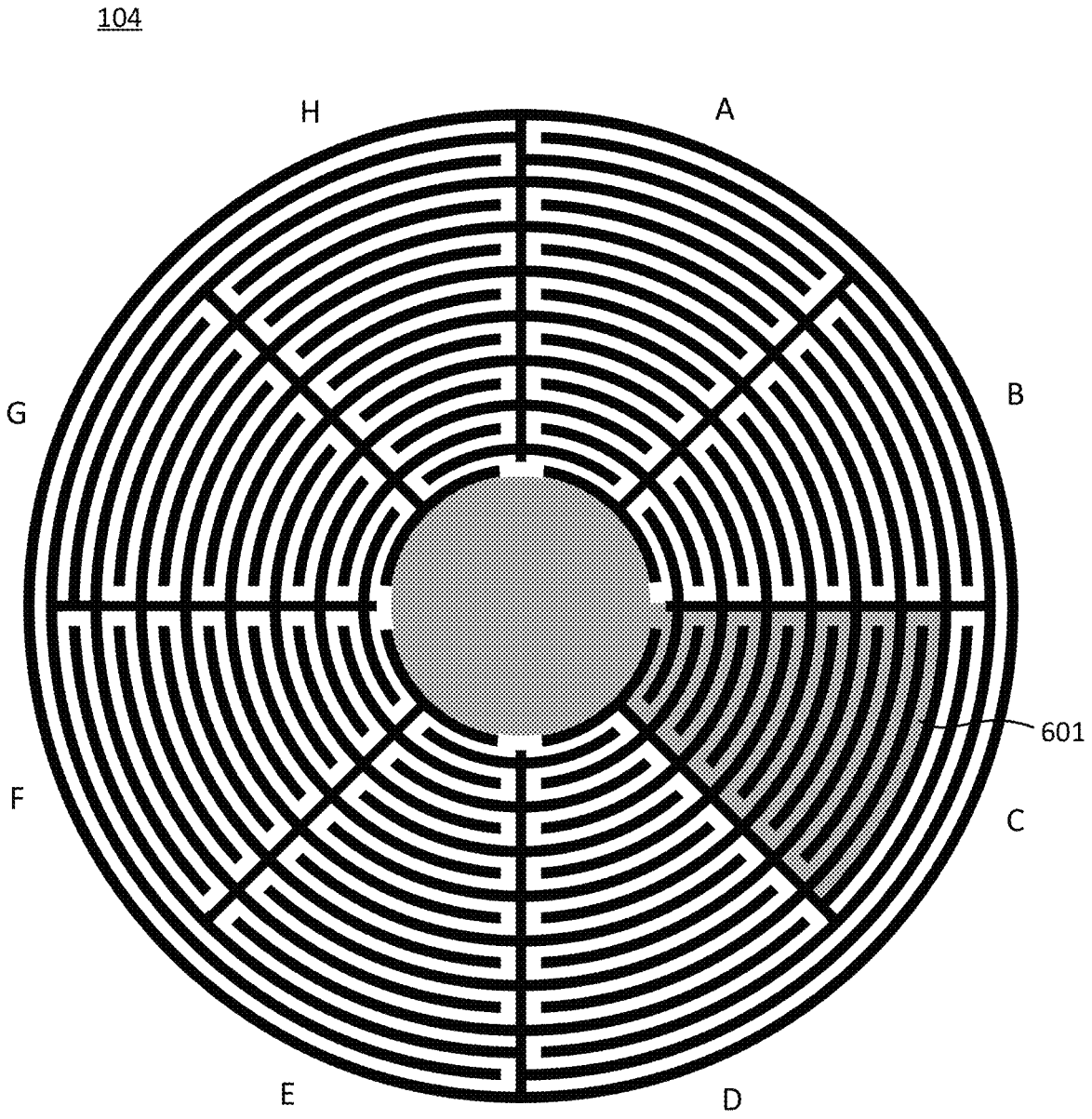

FIG. 6 shows another example of a tube 601 that corresponds to section C, again emphasized to make it easier to distinguish the tube from the other tubes and sections of low frequency extension filter 104. In this example, tube 601 also remains within its pie-shaped section defined between radial walls 301BC and 301CD.

Figure 7:
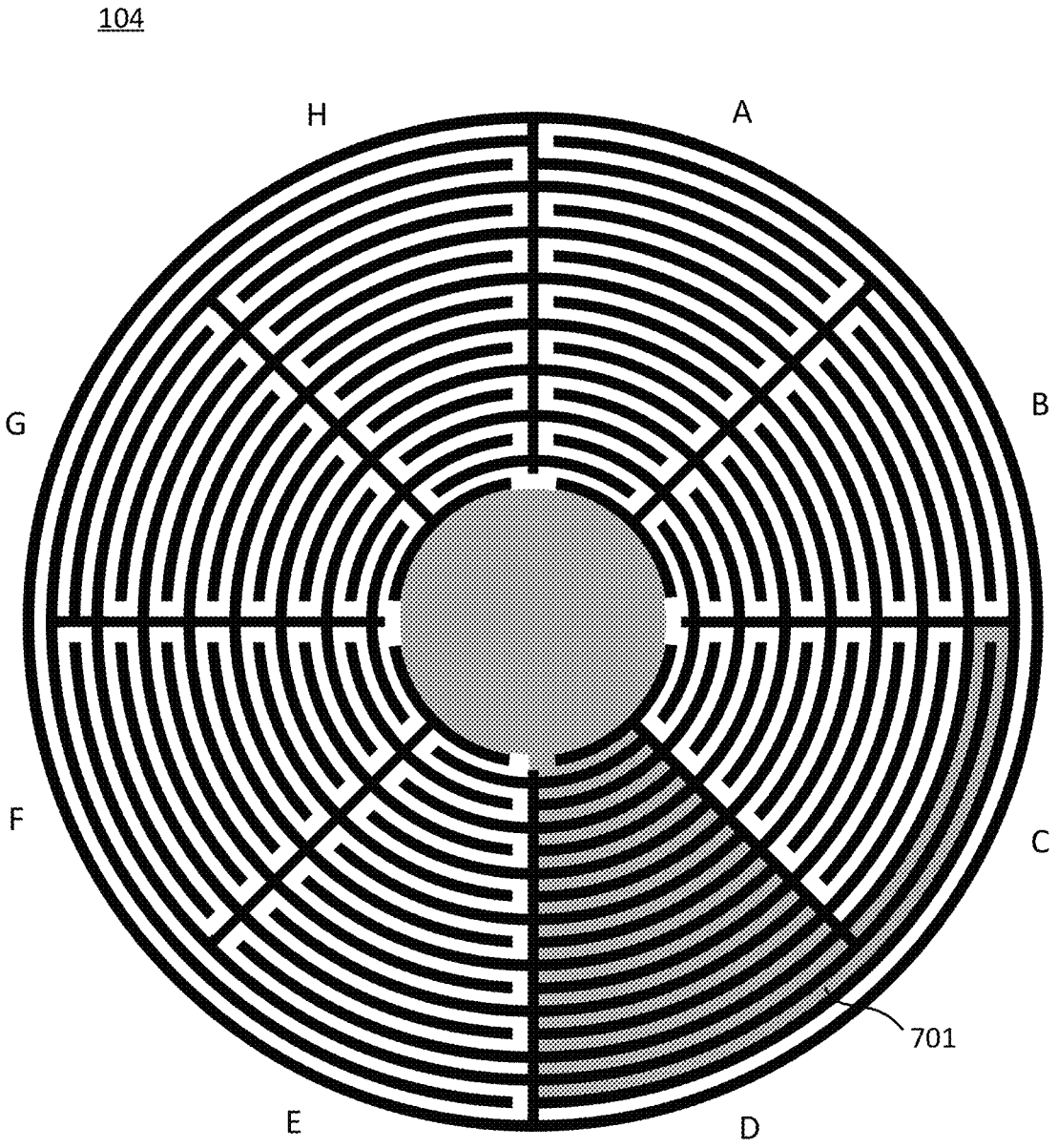

FIG. 7 shows another example of a tube 701 that corresponds to section D, again emphasized to make it easier to distinguish the tube from the other tubes and sections of low frequency extension filter 104. In this example, tube 701 generally remains within its pie-shaped section defined between radial walls 301CD and 301DE, and also partially extends beyond radial wall 301CD.

Each of these tubes 401, 501, 601, and 701 emphasized in FIGS. 4-7 has a different length corresponding to a different frequency band. The same is true of the remaining four tubes corresponding to sections E-H. To determine the lengths of the tubes, an initial calculation may involve taking one quarter of the wavelength of the frequency in free air. The equation for this would is: length=c/(4f), where c is, for example, approximately 343 meters/sec at 20 degrees Celsius, and where f is the center frequency (in hertz) of the frequency band. However, this calculation may not take into account certain factors that could impact the ideal tube length. For example, the tubes may each have a certain cross-sectional area that is small enough with respect to their length that the viscous losses of the tube's inner wall surfaces may be significant. If the cross-sectional area is sufficiently small with respect to the tube's length, then the length of the tube needed to resonate optimally may be a bit less than one quarter of a wavelength.

In one example embodiment, where the tubes of low frequency extension filter 104 have a rectangular cross-sectional shape made up of four perpendicular 5 mm walls (thus resulting in 25 square mm of cross-sectional area per tube), and taking into account viscous losses, the tube lengths have been calculated as shown for the following frequencies:

TABLE 1

Example Frequencies and Corresponding Tube Lengths

| Frequency (Hz) | Resonator Tube Length (m) |
|---|---|
| 140 | 0.614285714 |
| 154.5725319 | 0.556373108 |
| 170.6619116 | 0.50392029 |
| 188.426027 | 0.456412532 |
| 208.0392005 | 0.413383631 |
| 229.6938997 | 0.374411337 |
| 253.602626 | 0.339113208 |
| 280 | 0.307142857 |

The logistics of fitting eight channels that total approximately 3.56 m in length (in the present example) within the area of low frequency extension filter 104 involved an iterative design process. For example, the iterative design process resulting in the particular low frequency extension filter 104 shown in FIG. 3 (which has a circular layout and which uses 5 mm by 5 mm tubes) may involve segmenting a representative circle of approximately 105 mm in diameter into eight segments, each segment taking up the same angular width (in this example, each segment having an angular width of 22.5 degrees). The circle may be further subdivided into sixteen 5 mm wide circumferential channels (each extending around the circle at a different distance from its center). These channels may then selectively opened to form channels that follow tortuous paths, such as in a serpentine manner that mimics, for example, a traditional Greek labyrinth. Finally, a top surface may be placed over the channels to form the tubes. The resulting tubes may be empty (e.g., naturally filled with ambient air and no other substance) to allow for the acoustic energy to not be absorbed by the tubes in an undesirable manner. In this regard, a purpose of low frequency extension filter 104 may be to increase efficiency (and reduce internal acoustic impedance) at certain designed-for frequencies particularly in the bass region, rather than to absorb energy at those frequencies.

The geometry of low frequency extension filter 104 may be developed using design and manufacturing software such as NX, and then imported into physics modeling software such as COMSOL to determine the air resonance frequency using an acoustics module and an eigenfrequency solver. The physical implementation of the design may be performed using, for example, a 3D printer with conventional 3D printing materials such as plastic or other materials. After tuning the lengths of the individual channels, the final geometry may be developed. Using this process, the eigenfrequencies as calculated by the inventors for the particular example geometry described above and shown in FIG. 3 were as follows:

$$130.14694986593182+12.109782043560736i \text{ Hz}$$

$$144.06801486379595+12.254009097819758i \text{ Hz}$$

$$171.3592263830207+13.023017255005177i \text{ Hz}$$

$$188.29581560770052+13.411817789644426i \text{ Hz}$$

$$210.76477769185323+13.117674703946287i \text{ Hz}$$

$$229.00717584342897+12.795806806436937i \text{ Hz}$$

$$229.3793865576183+13.272769199959392i \text{ Hz}$$

$$263.23715375734133+13.193887679345387i \text{ Hz}$$

The tube lengths for a given implementation would ultimately depend upon the cross-sectional areas of the tubes, the material from which the tubes are made, and the desired frequency bands. Interestingly, the tube lengths may be shortened with smaller tube cross-sectional areas (thereby potentially allowing low frequency extension filter 104 to be even smaller and/or making it easier to lay out the tube paths), although this relationship would only be true up to a point where the cross-sectional areas would become too small to usefully receive the acoustic energy due to increased acoustic impedance of the tubes. Moreover, where low frequency extension filter 104 is of a different shape or size, the layout of the tubes may look different from implementation to implementation.

Figure 9:
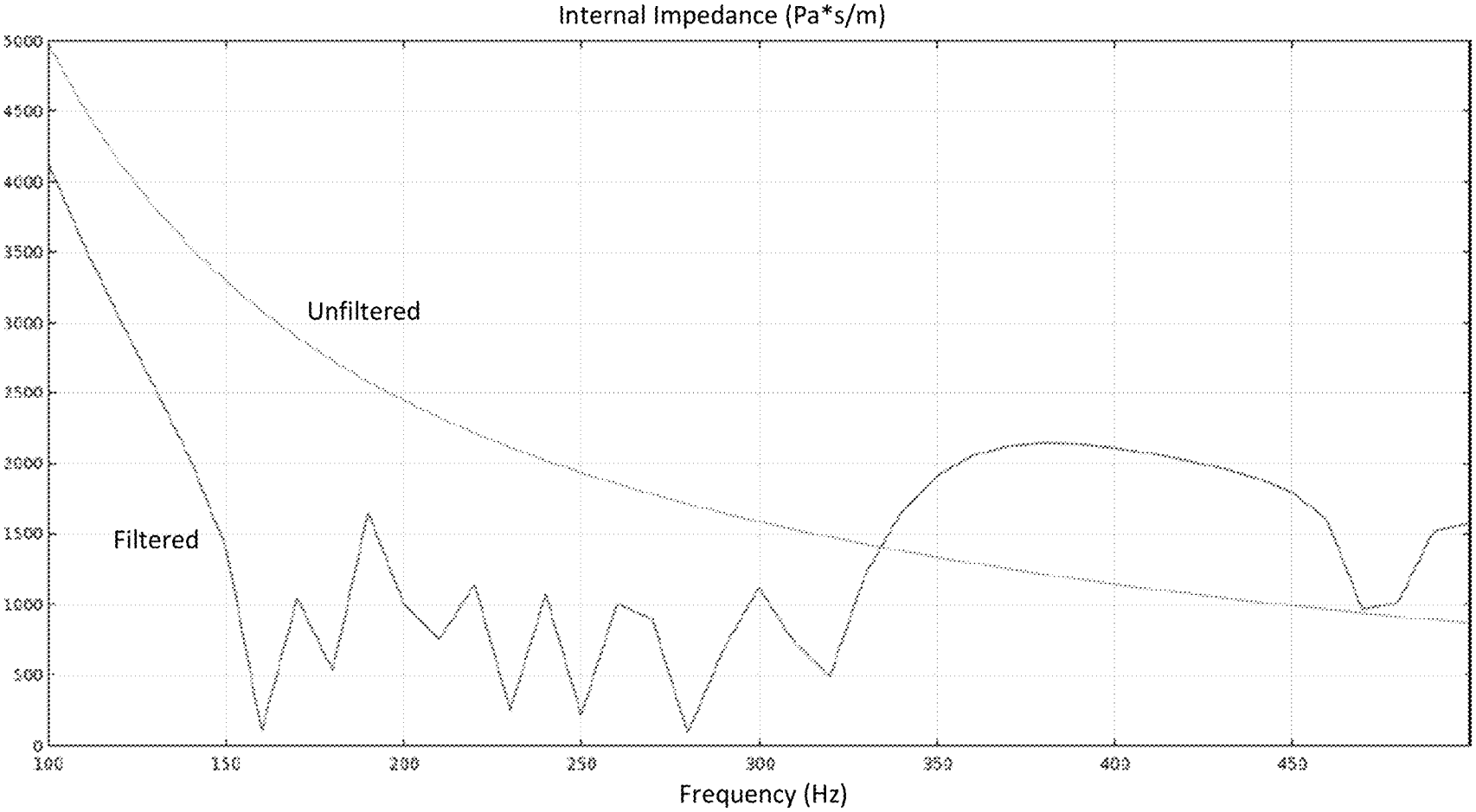
FIG. 9 is a graph showing an example of simulated internal impedance versus frequency for both a filtered audio device (that includes a low frequency extension filter) and a comparable unfiltered device (that does not include the low frequency extension filter).
Figure 10:
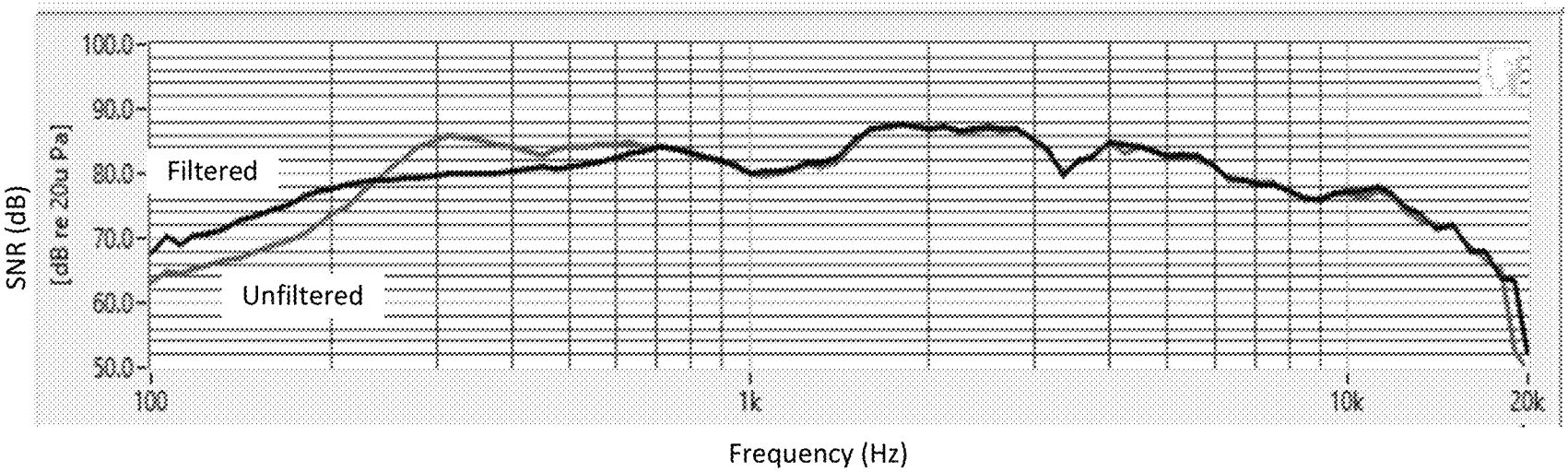
FIG. 10 is a graph showing an example of sound pressure level versus frequency for both a filtered audio device (that includes a low frequency extension filter) and a comparable unfiltered device (that does not include the low frequency extension filter).

The inventors also modeled the resulting enclosure including low frequency extension filter 104 as well as a comparable non-filtered enclosure, and then compared the internal impedance measurements of the two enclosures. Such an impedance measurement show the respective enclosure's resistance or air stiffness at a specific frequency. The comparison of the two impedances is shown in the graph of FIG. 9, which shows impedance versus frequency for both the filtered (i.e., including low frequency extension filter 104) and unfiltered (i.e., not including low frequency extension filter 104) cavities utilizing the same driver. As shown in FIG. 9, the impedance for the filtered cavity drops well below the impedance for the unfiltered cavity, particularly for the frequency range of the eight frequency bands discussed above. This should correspond to an increased sensitivity in that frequency range. Thus, low frequency extension filter 104 may act as a sort of low-pass rainbow filter, in which it causes impedance for each of a plurality of defined low-frequency bands to be reduced by reducing air stiffness in those frequency bands, thereby resulting in increased acoustical output by the corresponding driver in those frequency bands. The tradeoff is that the filtered impedance in this example increases for higher frequencies (e.g., starting at about 330 Hz) in comparison with the unfiltered impedance, and then unifies again at still higher frequencies (e.g., above 450 Hz). This behavior can also be seen in the frequency response of the two separate enclosures with the same driver, which is shown for this particular implementation in the graph of FIG. 10 that plots sound pressure level (dB SPL) versus frequency (Hz) for both the filtered and the unfiltered versions of the enclosure.

The above example used eight low frequency bands ranging from about 140 Hz to about 280 Hz. However, low frequency extension filter 104 may alternatively be tuned for other number of low frequency bands over other low frequency band ranges. For example, low frequency extension filter 104 may be tuned to frequency bands ranging from 100 Hz to 500 Hz, or for any sub-range therein. The wider the total frequency range over which a given number of frequency bands are spread, the less the frequency bands may overlap with one another (if at all), resulting in a less even frequency response in the low frequency range. However, this may be countered by increasing the number of frequency bands (and likewise the number of corresponding tubes/sections in low frequency extension filter 104, i.e., the number of frequency bands to which low frequency extension filter 104 is tuned).

The frequency bands to which low frequency extension filter 104 is tuned may be in a range of frequencies in which the upper end of the range of frequencies is below (and in some cases ends just below and/or up to) the transition point where the system response is dominated by stiffness-controlled response in lower frequencies and where the system response is dominated by mass-controlled response in relatively higher frequencies. These two types of response domains refer to how the driver's air-moving part (e.g., a speaker cone or other membrane) moves as a function of driving frequency. When the driving frequency is lower than resonance frequency, the air-moving part will generally displace itself approximately the same amount over a range of driving frequencies. As the frequency increases a bit, the displacement may gradually increase up to a point. This domain of driver operation is referred to as the stiffness-controlled response domain, because at lower frequencies the air-moving part of the driver moves slowly enough that its stiffness (e.g., based on how the air-moving part is connected to the fixed portion of the driver and/or based on any flexing that the air-moving part must undergo during displacement) rather than inertia dominate how far the air-moving part displaces. In the stiffness-controlled response domain, the displacement response of the driver (and the corresponding acoustical energy emitted from the driver, e.g., as indicated by its frequency response in this domain) generally dependent on the size of the enclosure for the driver along with mechanical stiffness of the air-moving part (e.g., cone and suspension system for the cone).

On the other hand, when the driving frequency is higher than the resonance frequency, the displacement of the air-moving part will generally be reduced toward zero as the frequency increases. This domain of driver operation is referred to as the mass-controlled response domain, because at higher frequencies the inertia of the air-moving part becomes significant and limits how far it can be displaced in a relatively short period of time (e.g., the cycle period of the frequency). In the mass-controlled response domain, the displacement response of the driver (and the corresponding acoustical energy emitted from the driver, e.g., as indicated by its frequency response in this domain) is generally independent of the size of the enclosure for the driver.

Figure 11:
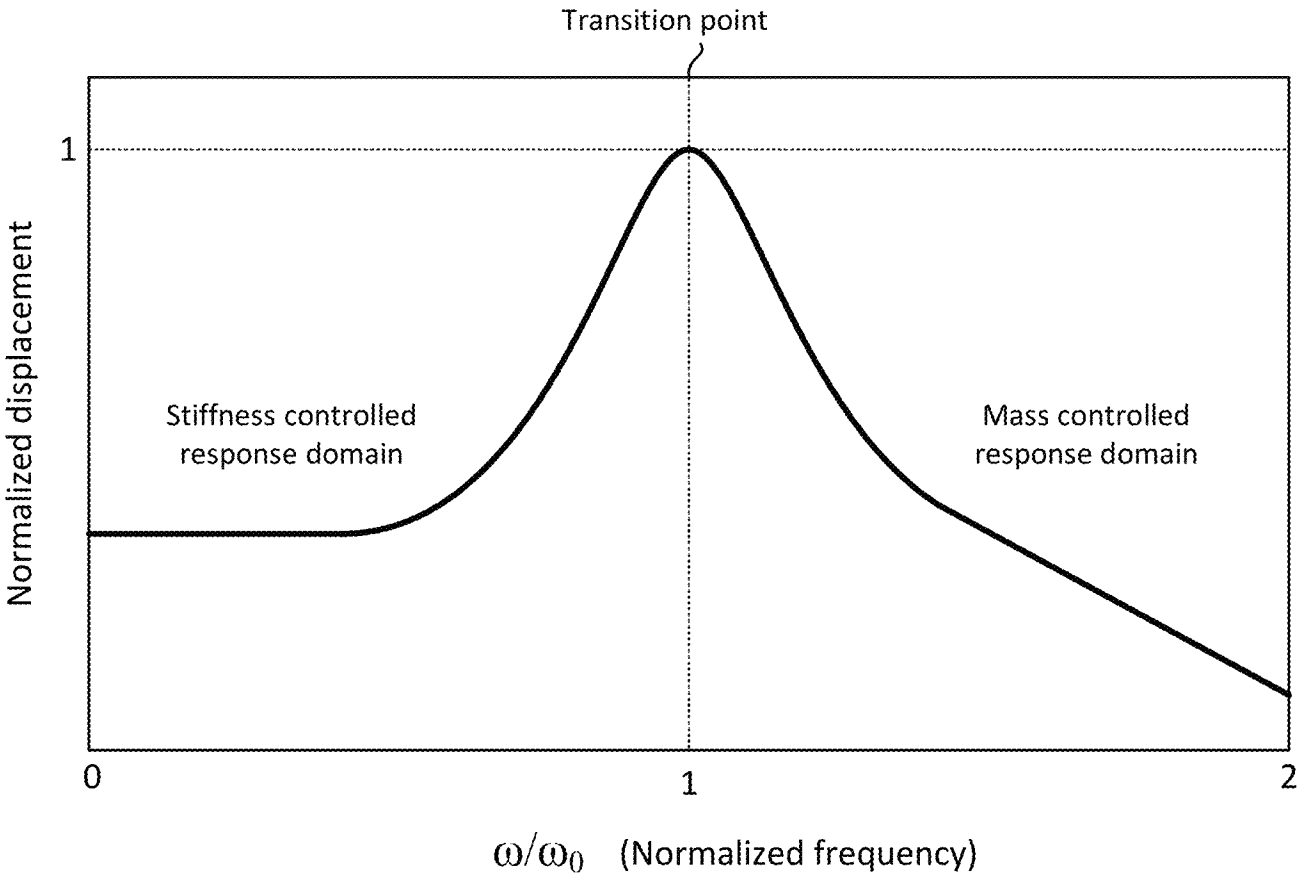
FIG. 11 is a graph showing an example speaker displacement response in both the stiffness-controlled domain and the mass-controlled domain.

There is a rather sharp transition point between the two domains, in which the displacement begins to increase in the stiffness-controlled domain as the frequency approaches the transition point. Then, as the transition point is passed and the frequency continues to increase, the displacement begins to decrease as inertia exerts its larger and larger influence. The transition point may be modeled ideally using the following equation:

$$\omega_0 = \sqrt{\frac{s}{m}}$$

where $\omega_0$ is the undamped natural (resonance) frequency response of the system, s is the stiffness of the air-moving part, and m is the mass of the air-moving part. An example graph showing this behavior is shown in FIG. 11, in which the transition point between the two domains is indicated by the vertical broken line at the normalized frequency of $\omega/\omega_0$, where $\omega$ is the driving frequency.

Figure 12:
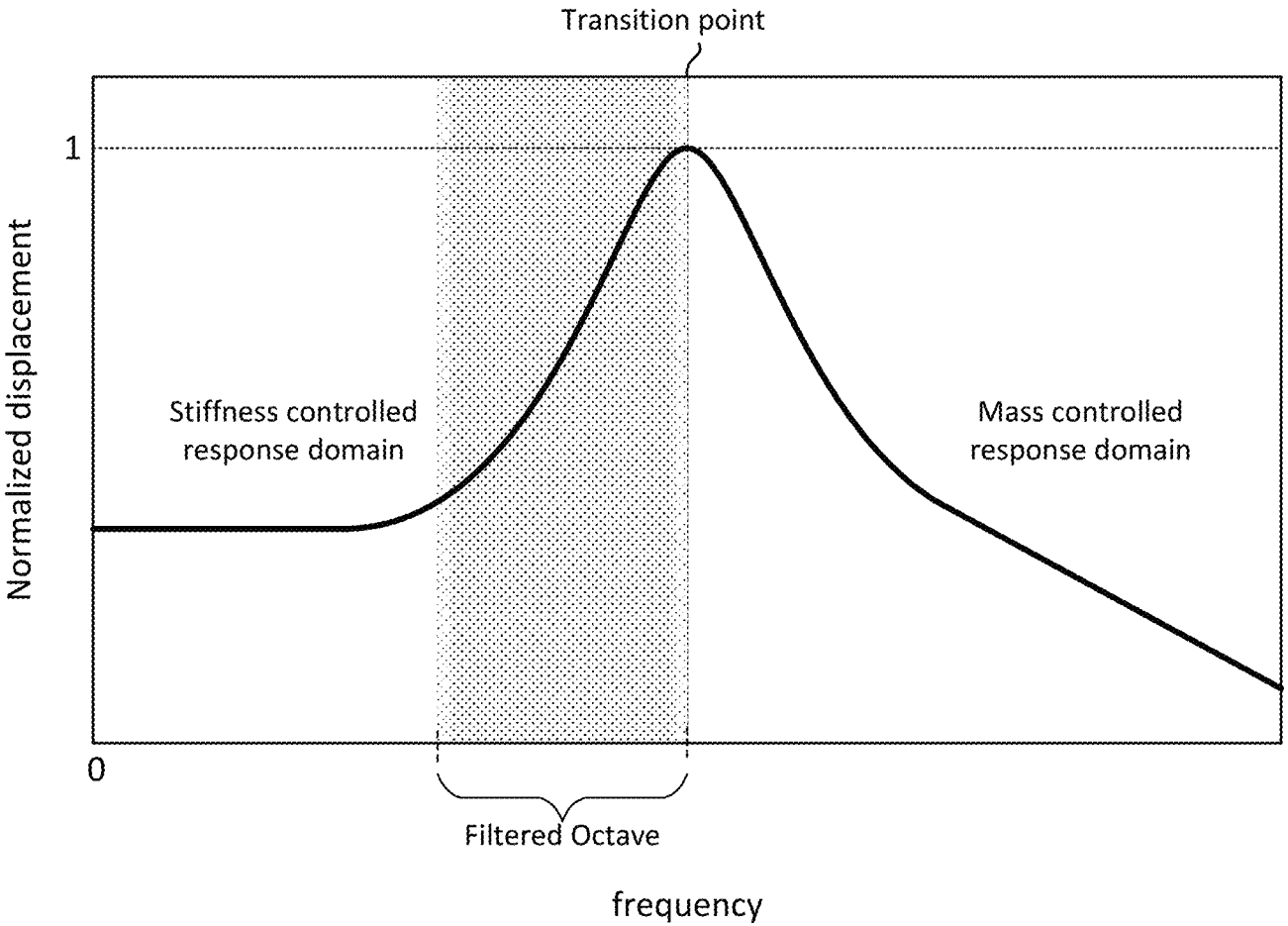
FIG. 12 is a graph showing an example speaker displacement response with an overlay of an example filtered octave.

As previously described, the frequency bands to which low frequency extension filter 104 may be tuned, may be in a range of frequencies in which the upper end of the range of frequencies is below (and in some cases ends just below and/or up to) the transition point between the stiffness-controlled response domain and the mass-controlled response domain. For example, the frequency range within which the plurality of frequency bands reside may be within an octave frequency range ending at or just below the transition point. Selecting such a frequency range below the transition point may reduce or even minimize harmonically-based distortions at the next higher octave, which would be in the mass-controlled response domain. Because low frequency extension filter 104 in such a case would be tuned in this way, low frequency extension filter 104 tuned in such a case may be expected to reduce or even minimize the air stiffness experienced by the system, while not significantly affecting the mass-controlled response of the system (which dominates the response in the next higher octave). An example of such a tuned-to octave is indicated in FIG. 12, labeled as the "Filtered Octave." While not explicitly shown in the drawing, the plurality of tuned-to frequency bands (such as those shown in Table 1, above) would be located within the filtered octave or other tuned-to frequency range. For the Table 1 example, the filtered octave is the octave from 140 Hz to 280 Hz.

Referring to the example tube lengths in Table 1 above, where the cross-sectional area is 25 mm (e.g., 5 mm by 5 mm square), for example, then the ratios of tube lengths to cross-sectional area would be in the range of approximately 12.3 $mm^{-1}$ (307.142857 mm/25 $mm^2$) to approximately 24.6 $mm^{-1}$ (614.285714 mm/25 $mm^2$). However, other ratios may be used, such as ratios anywhere in the range of 10 $mm^{-1}$ to 30 $mm^{-1}$, or ratios below or above that range. Where an octave is being filtered, the ratios for low frequency extension filter 104 may be expected to range from R to approximately 2*R, where R is the smaller ratio (e.g., 12.3 $mm^{-1}$) and 2*R is double that ratio (e.g., 24.6 $mm^{-1}$). Moreover, as stated previously, the entrances to each of the tubes (e.g., the openings at the circumference of central cavity 105) may be flared to a larger cross-sectional area to increase acoustic energy transfer into and out of the tubes and reduce the occurrence of sudden acoustic impedance transitions at the entrances of the tubes.

Figure 8:
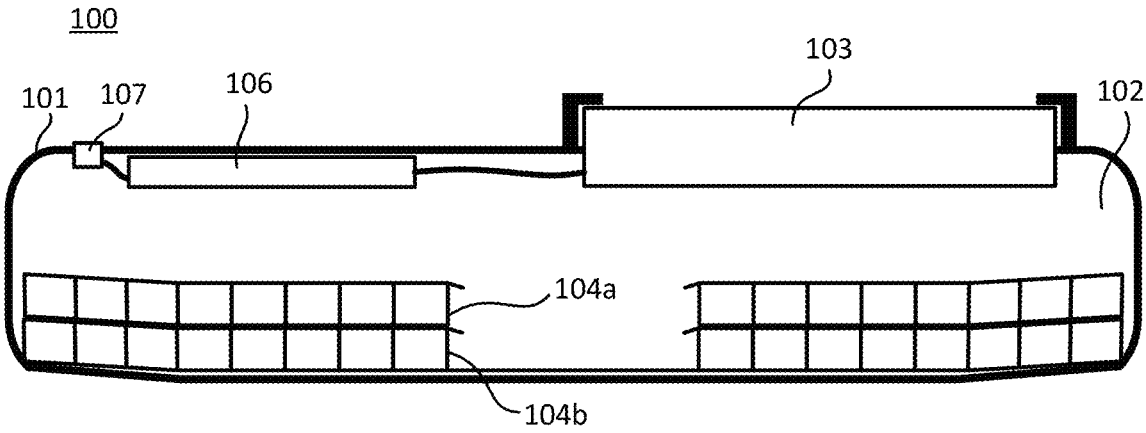
FIG. 8 is a side view of another example device comprising a speaker, a microphone, and a low frequency extension filter.

FIG. 8 shows another example of device 100, except that two low-frequency extension filters 104 (104*a* and 104*b*) are stacked, one on top of another. The two low-frequency extension filters 104 may be differently tuned, thereby allowing for more tuned frequency channels. For example, low-frequency extension filter 104*a* may be tuned to a first set of frequency channels, and low-frequency extension filter 104*b* may be tuned to a different, second set of frequency channels.

Figure 13:
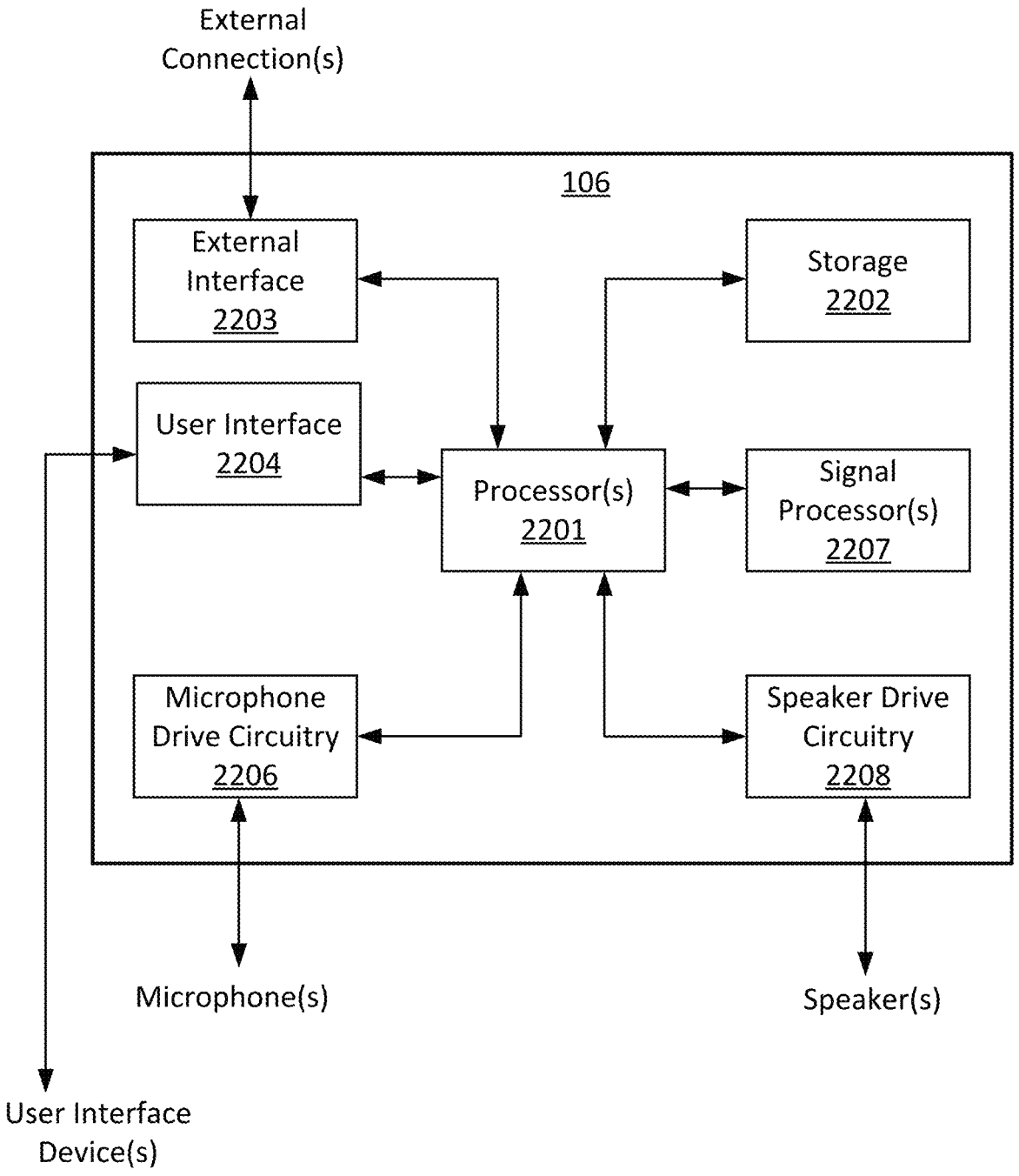
FIG. 13 is a block diagram showing an example configuration of a computing device, which may be used to implement at least part of any of the devices described herein, such as controller 106.

FIG. 13 shows an example block diagram of controller 106. Controller 106 may be implemented as, for example, a computing device that executes stored instructions, and/or as hard-wired circuitry that may or may not execute stored instructions. In the shown example, controller 106 may comprise or be connected to any of the following: one or more processors 2201, storage 2202 (which may comprise one or more computer-readable media such as memory), an external interface 2203 (which may be, or be connected to, a communication module such as described previously), a user interface 2204, microphone drive circuitry 2206 configured to receive audio information signals from one or more microphones of device 101 (such as microphones 107, 107*a*, and/or 107*b*), one or more digital signal processors

2207 configured to implement any digital signal processing of device 100 such as AEC and/or LF boost, and/or speaker drive circuitry 2208 configured to provide audio signals to one or more drivers of device 101 (such as speaker 103), and to cause the one or more drivers to produce sound.

The one or more processors 2201 may be configured to execute instructions stored in storage 2202. The instructions, when executed by the one or more processors 2201, may cause controller 106 (and thus device 100) to perform any of the functionality described herein performed by controller 106 and/or device 100.

Power may be provided to controller 106, driver 103, microphones 107, 107*a*, and/or any other elements of device 100 as appropriate. While not explicitly shown, any of the example devices 100 described and illustrated herein may include an internal battery and/or an external power connection.

While some of the drawings show examples of device 100 having particular features such as a particular housing shape, one or more low-frequency extension filters, one or more speaker drivers, one or more microphones, wiring, and/or a controller, and other drawings may not, their absences from particular drawings is not meant to imply that those features are not present in those examples. Any of the device 100 examples described and illustrated herein may include any of these and the other features described herein, in any combination or subcombination. For example, while particular housing 101 shapes are illustrated in particular examples of device 100, any of the device 100 examples may use any housing shape.

More generally, although examples are described above, features and/or steps of those examples may be combined, divided, omitted, rearranged, revised, and/or augmented in any desired manner. Various alterations, modifications, and improvements will readily occur to those skilled in the art. Such alterations, modifications, and improvements are intended to be part of this description, though not expressly stated herein, and are intended to be within the spirit and scope of the disclosure. Accordingly, the foregoing description is by way of example only, and is not limiting.

The invention claimed is:

1. An audio apparatus comprising:
- a housing forming an acoustically closed interior space;
- a speaker coupled to the housing and configured to emit sound; and
- a low-frequency filter disposed within the interior space and configured to filter a plurality of frequency bands within a stiffness-controlled response domain of the audio apparatus, the low-frequency filter comprising a plurality of acoustic pathways, wherein:
  - each of the plurality of acoustic pathways comprises a first end that is open to the interior space and a second end that is closed; and
  - each of the plurality of acoustic pathways has a different length corresponding to a different frequency band of the plurality of frequency bands within the stiffness-controlled response domain of the audio apparatus.

2. The audio apparatus of claim 1, wherein the plurality of acoustic pathways are configured to reduce air stiffness within the plurality of frequency bands.

3. The audio apparatus of claim 1, wherein each of the plurality of acoustic pathways is filled only with air.

4. The audio apparatus of claim 1, wherein each of the plurality of acoustic pathways comprises a tube.

5. The audio apparatus of claim 1, wherein the first end of each of the plurality of acoustic pathways comprises a flared opening.

6. The audio apparatus of claim 1, wherein the plurality of acoustic pathways comprises:
- a first acoustic pathway;
- a second acoustic pathway;
- a third acoustic pathway; and
- a fourth acoustic pathway,
- wherein the first ends of the first acoustic pathway and the second acoustic pathway share a first opening to the interior space, and
- wherein the first ends of the third acoustic pathway and the fourth acoustic pathway share a second opening to the interior space.

7. The audio apparatus of claim 1, wherein each of the plurality of acoustic pathways has a ratio of length to cross-sectional area in a range of 10 $mm^{-1}$ to 30 $mm^{-1}$.

8. The audio apparatus of claim 1, wherein each of the plurality of acoustic pathways has a ratio of length to cross-sectional area in a range of 12.3 $mm^{-1}$ to 24.6 $mm^{-1}$.

9. The audio apparatus of claim 1, wherein at least some of the plurality of frequency bands overlap.

10. An audio apparatus comprising a low-frequency filter configured to filter within a range of frequencies below about 500 Hz, the low-frequency filter comprising:
- a plurality of acoustic pathways,
- wherein each of the plurality of acoustic pathways comprises a first end that is open such that at least a portion of acoustic energy received by the low-frequency filter is received at the first end,
- wherein each of the plurality of acoustic pathways comprises a second end that is closed, and
- wherein at least some of the plurality of acoustic pathways comprise different tortuous acoustic pathways and have different lengths corresponding to different frequency bands of a plurality of frequency bands within the range of frequencies.

11. The audio apparatus of claim 10, wherein each of the plurality of acoustic pathways is filled only with air.

12. The audio apparatus of claim 10, further comprising a housing that comprises:
- the plurality of acoustic pathways;
- a first opening; and
- a second opening,
- wherein the plurality of acoustic pathways comprises:
  - a first acoustic pathway;
  - a second acoustic pathway;
  - a third acoustic pathway; and
  - a fourth acoustic pathway,
- wherein the first ends of the first acoustic pathway and the second acoustic pathway are open to the first opening, and
- wherein the first ends of the third acoustic pathway and the fourth acoustic pathway are open to the second opening.

13. The audio apparatus of claim 10, wherein the low-frequency filter comprises a portion that bends at an outer periphery of a body of the apparatus and that comprises at least a portion of one or more of the plurality of acoustic pathways.

14. The audio apparatus of claim 10, wherein the range of frequencies is below about 280 Hz.

15. An audio apparatus comprising:
- a housing forming an acoustically closed interior space;
- a speaker coupled to the housing and configured to emit sound; and a low-frequency filter disposed within the interior space and configured to filter a plurality of frequency bands below a transition point frequency at which a mass-controlled response domain of the audio apparatus begins, the low-frequency filter comprising a plurality of acoustic pathways, wherein:

each of the plurality of acoustic pathways comprises a first end that is open to the interior space and a second end that is closed; and each of the plurality of acoustic pathways has a different length corresponding to a different frequency band of the plurality of frequency bands below the transition point frequency at which the mass-controlled response domain of the audio apparatus begins.

16. The audio apparatus of claim 15, wherein the plurality of acoustic pathways are configured to reduce air stiffness within the plurality of frequency bands.

17. The audio apparatus of claim 15, wherein each of the plurality of acoustic pathways is filled only with air.

18. The audio apparatus of claim 15, wherein each of the plurality of acoustic pathways has a ratio of length to cross-sectional area in a range of 10 $mm^{-1}$ to 30 $mm^{-1}$.

19. The audio apparatus of claim 1, wherein the plurality of frequency bands comprises a frequency band below 280 Hz.

20. The audio apparatus of claim 10, further comprising a housing forming an acoustically closed interior space, wherein the first end of each of the plurality of acoustic pathways is open to the interior space.

* * * * *